US006354379B2

(12) United States Patent
Miszewski et al.

(10) Patent No.: US 6,354,379 B2
(45) Date of Patent: Mar. 12, 2002

(54) OIL WELL SEPARATION METHOD AND APPARATUS

(76) Inventors: Antoni Miszewski, 10 Boucher Road, Budleigh Salterton, Devon EX9 6JF; James Barrett, Casa Mia, Green End Lane, Plymtree, Cullompton,Devon EX15 2JR; Richard Stevens, Blackwater House, Blackwater Grove, Alderholt, Fordinbridge, Hampshire SP6 3AD, all of (GB)

( * ) Notice: Subject to any disclaimer, the term of this patent is extended or adjusted under 35 U.S.C. 154(b) by 0 days.

(21) Appl. No.: 09/247,472

(22) Filed: Feb. 8, 1999

(30) Foreign Application Priority Data

Feb. 9, 1998 (GB) ..... 9802633
Nov. 14, 1998 (GB) ..... 9824933

(51) Int. Cl.[7] ..... E21B 23/04
(52) U.S. Cl. ..... 166/377; 166/376
(58) Field of Search ..... 166/376, 377

(56) References Cited

U.S. PATENT DOCUMENTS 4,275,786 A * 6/1981 Lee ..... 166/65 R
4,501,440 A 2/1985 Anderson
4,640,354 A * 2/1987 Boisson ..... 166/376
5,257,663 A 11/1993 Pringle
6,032,733 A * 3/2000 Ludwig et al. ..... 166/60

FOREIGN PATENT DOCUMENTS

| | | |
|---|---|---|
| GB | 2 264 136 | 8/1993 |
| GB | 2 278 135 | 11/1994 |
| GB | 2 291 451 | 1/1996 |

* cited by examiner

*Primary Examiner*—Thomas B. Will
*Assistant Examiner*—Meredith C. Petravick
(74) *Attorney, Agent, or Firm*—Herbert Dubno

(57) ABSTRACT

A separation method and apparatus for separating components used in downhole well development activity, whilst in position down the well. Method and apparatus are characterized in that they do not make use of external mechanical forces, or internal fluid pressure, applied through the development apparatus to render the components in a separable state. The release is achieved through the use of a fusible metal element.

5 Claims, 4 Drawing Sheets

OIL WELL SEPARATION METHOD AND APPARATUS

FIELD OF THE INVENTION

This invention relates to a separation method and apparatus, and has been devised, in particular, to provide a method of, and apparatus for, separating components situated down a drilled well.

BACKGROUND

In the development of oil wells, and in intervention operations, coiled tubing is used extensively to deploy a variety of tools down the well, and it is now becoming commonplace to run single or multi-cored armoured electrical cable within such tubing.

As the depth of wells increase, along with the complexity of the wells and the varying configurations of the various tools, the danger of a tool becoming stuck somewhere in a well becomes greater. The consequences of a tool becoming stuck in a well are potentially costly and may include loss of, or damage to, the downhole tool, the coiled tubing, and/or the well itself.

Thus, in the event of a tool becoming stuck in a well, it is desirable to be able to separate the tool from the tubing, in a controlled way, using a purpose built release mechanism.

Release mechanisms exist in various forms, operated variously by pressure applied through the coiled tubing, or by direct pull. However such existing mechanisms tend to restrict the scope of operations of the equipment. For example, in the case of direct pull operated release, the design maximum loads expected in normal execution of a job must fall below the separation load of the release mechanism by a considerable safety margin, to avoid unwanted release. In the case of a pressure operated release, operations which involve pumping a fluid through the coiled tubing (e.g. lifting or killing the well) must be closely monitored to ensure that the differential pressure created in the tube, by pumping, does not reach that at which disconnection will occur. This increases the time taken for the pumping operation.

It is an object of the present invention to provide a separation method and apparatus which will address the aforegoing problems or which will at least provide a useful choice.

SUMMARY OF THE INVENTION

According to one aspect of the invention, there is provided separation apparatus operable to separate components positioned down a well, said apparatus including a substantially cylindrical body section able to withstand loads in tension, compression and torsion; and electrically operable release means operable to separate parts of said body section, said release means being operable independently of any supply of fluid under pressure to said or through said body and independently of any tension, compression or torsion loads applied to said body section, characterized in that the release means comprises a fusible metal component.

The invention also provides apparatus adapted to be connected to an end of a coiled tube and comprises a through-bore through said body section to allow fluid under pressure to be conveyed through said apparatus.

The apparatus is preferably constructed and arranged to receive fluid under pressure from the environment surrounding, said apparatus, when submerged down a well, to cause said parts to undergo relative displacement.

The invention also provides apparatus adapted to be connected to a wireline.

The invention also provides apparatus wherein the metal includes tin and/or bismuth.

Preferably said release means includes a release catch operable by the melting of the fusible metal element, after which parts of said body section may be displaced with respect to one another to effect separation. Whilst some form of mechanical biasing means may be provided to displace the parts of said body section with respect to one another, the apparatus is preferably constructed and arranged to receive fluid under pressure from the environment surrounding said apparatus, when submerged down a well, to cause said parts to undergo relative displacement.

Preferably said apparatus is as hereinafter described.

Many variations in the way the present invention might be performed will present themselves to those skilled in the art. The description which follows is intended only as an illustration and the absence of particular alternatives or variants should in no way be applied to limit the scope of the invention. Such description of specific elements as follows should also be interpreted as including equivalents whether existing now or in the future. The scope of the invention should be determined solely by the appended claims.

BRIEF DESCRIPTION OF THE DRAWINGS

One form of apparatus embodying the invention will now be described with reference to the accompanying drawings in which.

DETAILED DESCRIPTION OF THE EMBODIMENTS OF THE INVENTION

Figure 1:
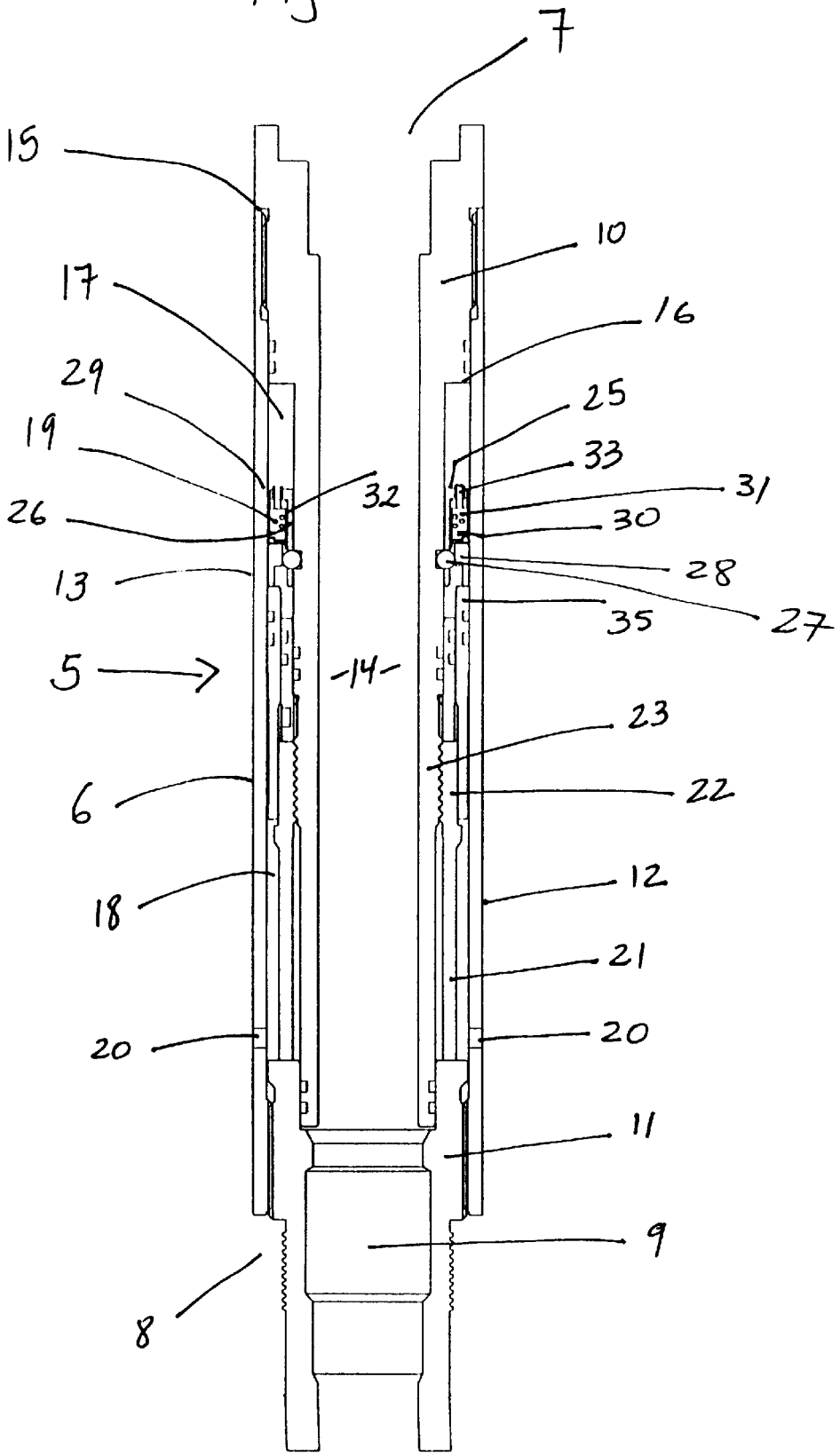
FIG. 1 shows a vertical section through separation apparatus according to the invention, in an assembled state.
Figure 2:
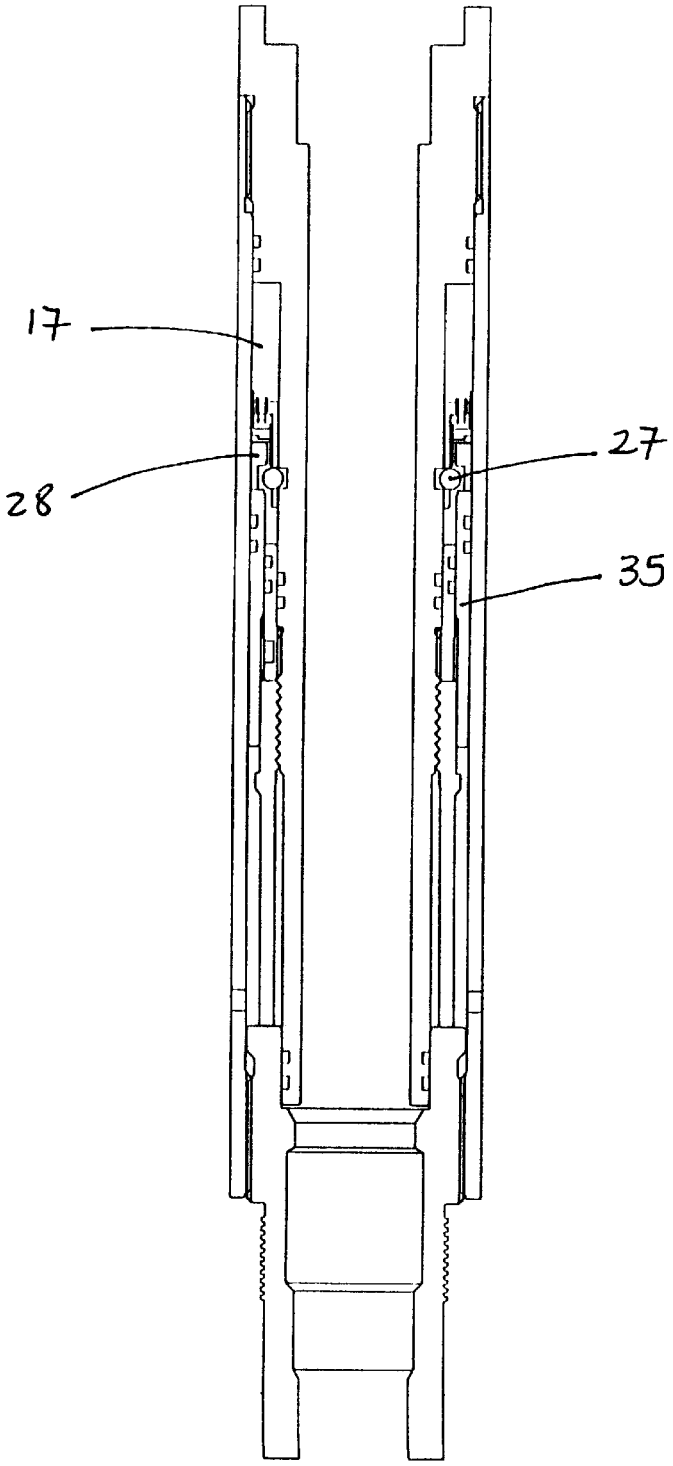
FIG. 2 shows a similar view to FIG. 1 but with the apparatus in a state of partial release.
Figure 3:
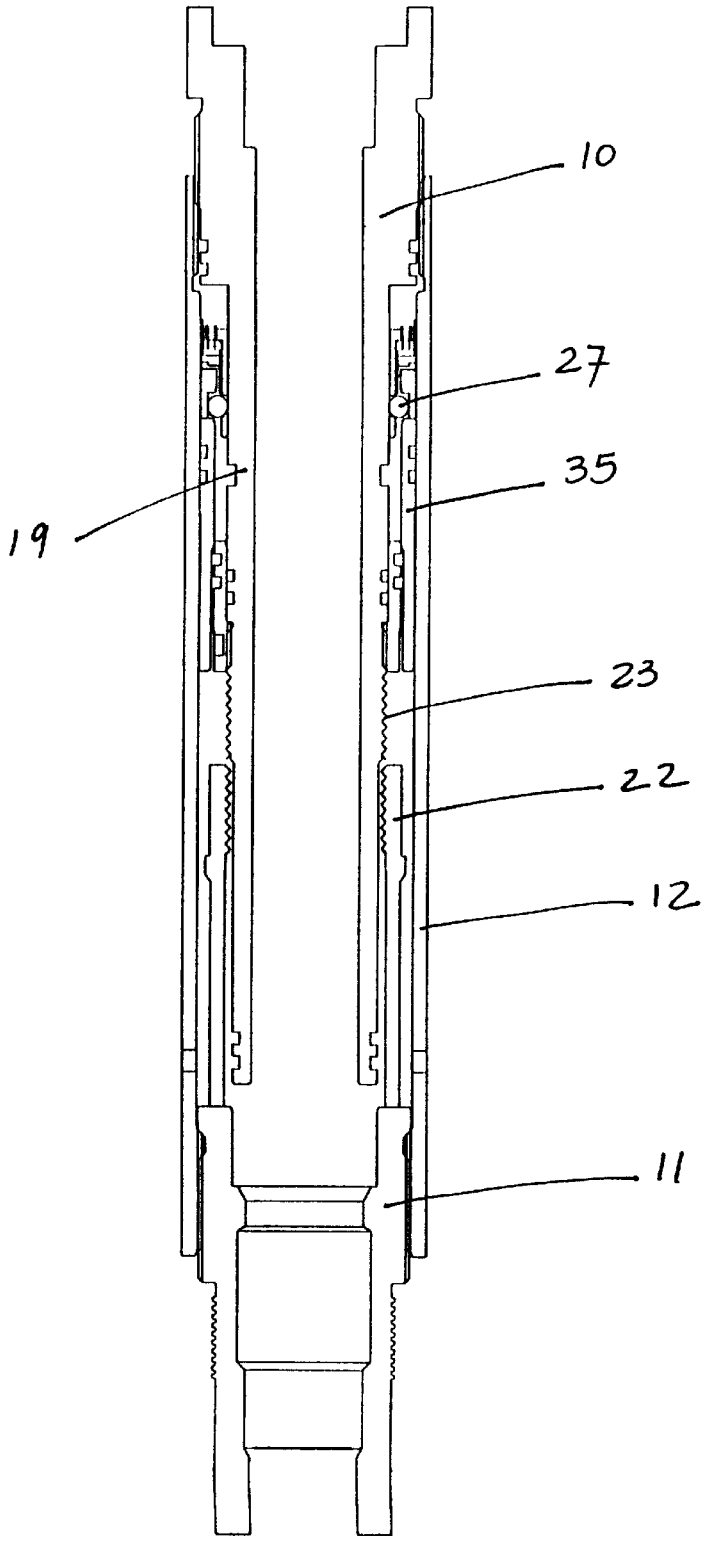
FIG. 3 shows a similar view to FIGS. 1 and 2 but with the apparatus in a state of full release.

Referring to FIGS. 1 to 3 of the drawings, the present invention provides separation apparatus 5 having a generally cylindrical body section 6. The upper end 7 of the body section is configured for attachment to a tool (not shown) above, or to the lower end of coiled tubing (not shown) of the type used in well development. The lower end 8 of the body section is configured for engagement with an industry standard fishing neck, shown in outline by reference numeral 9.

In the form shown the body section is composed of three principal parts, an upper adapter 10, a release mandrel 11, and an outer sleeve 12. Release means, generally designated 13, retain the parts together during normal well development operations, but allow separation of the componentry mounted on the lower end 8 from that engaging upper end 7 in a manner which will be described hereinafter.

The components 10, 11 and 12 are splined together to permit torsional loads to be applied through the apparatus, the components 10 and 11 also being interconnected in such a way as to allow tension and compression forces to be applied therethrough.

The upper adapter 10 is, itself, a generally cylindrical member having a through-bore 14 through which, in use, fluid may be passed under pressure for use in well development procedures. Such procedures may comprise, for example, powering a drill motor, lifting or killing the well. The upper adapter extends for substantially the entire length of the body section and engages the inner surface of the release mandrel at its lower end.

The outer surface of the upper adapter is stepped at 15 to receive the outer sleeve 12 and ensure the outer surface of the apparatus presents a relatively smooth cylindrical surface. The upper adapter 10 is further stepped at 16 so as to, in combination with the inner surface of the sleeve 12, define a drain chamber 17 above the release means 13. A further chamber 18 is defined between the outer sleeve and the upper adapter below the release means. Finally, the outer adapter includes a plurality of blind holes 19 which contribute to the release function as described below.

The outer sleeve 12 is a simple cylindrical member engaging the upper adapter 10 at its upper end, and sliding over the upper end of the release mandrel 11 at its lower end. Radial vent holes 20 place the chamber 18 in communication with the atmosphere surrounding the apparatus.

The release mandrel 11 includes, at its lower end, the adaptation 8 configured to engage the industry standard neck 9. Extending upwardly therefrom, and passing through the chamber 18, are a plurality of sprung fingers 21 having a series of peripheral threads 22 about the upper edges thereof, which threads 22 engage corresponding peripheral threads 23 extending about the outer surface of the upper adapter. It will be appreciated that these inter engaged threads permit tension and compression forces to be applied through the apparatus. The fingers 21 are sprung so as to engage threads 22 with threads 23. The threads are normally secured against disengagement by the release means 13. However, when the release means 13 is operated, and the security removed, a minor tension force applied to the upper adaptor will cause threads 22 to ride over threads 23.

The release means 13 comprises a ball cage 25 having a series of radial holes 26 therein which align with the holes 19 and serve, in combination with ball retaining ring 28, to locate and retain ball bearings 27 which provide a locking function. The components are sized so that ball bearings 27 will be expelled from holes 19 upon axial movement of the ball retaining ring 28.

A fusible metal assembly 29 is retained axially, between the ball retaining ring 28 and the ball cage 25. The fusible metal assembly consists of a ring 30 of cast, low melting point metal, surrounded by a jacket 31 of heat insulating material. An electrical heating element 32 is embedded in the metal ring 30 whilst a drain port 33 is provided through the upper edge of the insulating jacket 31 so as to place the metal ring 30 in communication with the drain chamber 17.

The material of the fusible metal assembly may be a relatively pure metal or an alloy. If it is an alloy, it is preferably such that it has a relatively well-defined melting point, such as a near eutectic alloy, rather than one which has a relatively broad temperature range between beginning to soften and fully liquid, such as a solder. Convenient materials for the metal include tin, bismuth, and various alloys thereof.

Finally the release means 13 includes a release sleeve 35 which fits over the outside of the sprung fingers 21 of the release mandrel, and thus normally serves to retain the threads 22 in engagement with the threads 23. The release sleeve 35 is capable of axial movement and a hydraulic seal is formed between the release sleeve, the outer sleeve, and the fingers such that the release sleeve may act as a piston. It will be seen that the lower edge of the release sleeve forms part of the upper boundary of chamber 18.

The release operation of the apparatus will now be described.

The apparatus is assembled at ground level. For this reason, the sealed drain chamber 17 is at atmospheric pressure. As the apparatus enters a well, the pressure surrounding the apparatus increases with depth. Fluid or gas under pressure from the well enters chamber 18 through vent holes 20 and this fluid or gas causes an upwards force on the release sleeve 35 which is resisted by the ball cage 25.

Referring now to FIGS. 2 & 3, if it is required to operate the release, an electrical current is passed through the element 32 embedded in the fusible metal assembly. This causes the metal ring 30 to melt and the molten metal to flow into drain chamber 17 through drain port 33.

As the metal ring 30 melts and collapses, the release sleeve 35, under the bias of the pressure in chamber 18, displaces the ball retaining ring 28 axially and allows the ball bearings 27 to release from holes 19. This then permits the ball cage 25 to move axially until the release sleeve clears the sprung fingers 21 as shown in FIG. 3. As the release sleeve 3 5 clears the fingers 21, the security restraint maintaining threads 22 in contact with threads 23 is removed. In this situation, application of a relatively minor tensile load to the upper adaptor 10 will cause threads 22 to ride over threads 23 and, in turn, permit the upper adapter to be drawn away.

When the upper adaptor is pulled clear, unimpeded access is permitted to an industry standard fishing neck in the downhole half of the tool.

It will thus be appreciated that the invention provides a form of separation apparatus which permits all usual well development activity to proceed without risk of separation, yet permits easy separation when required.

Figure 4:
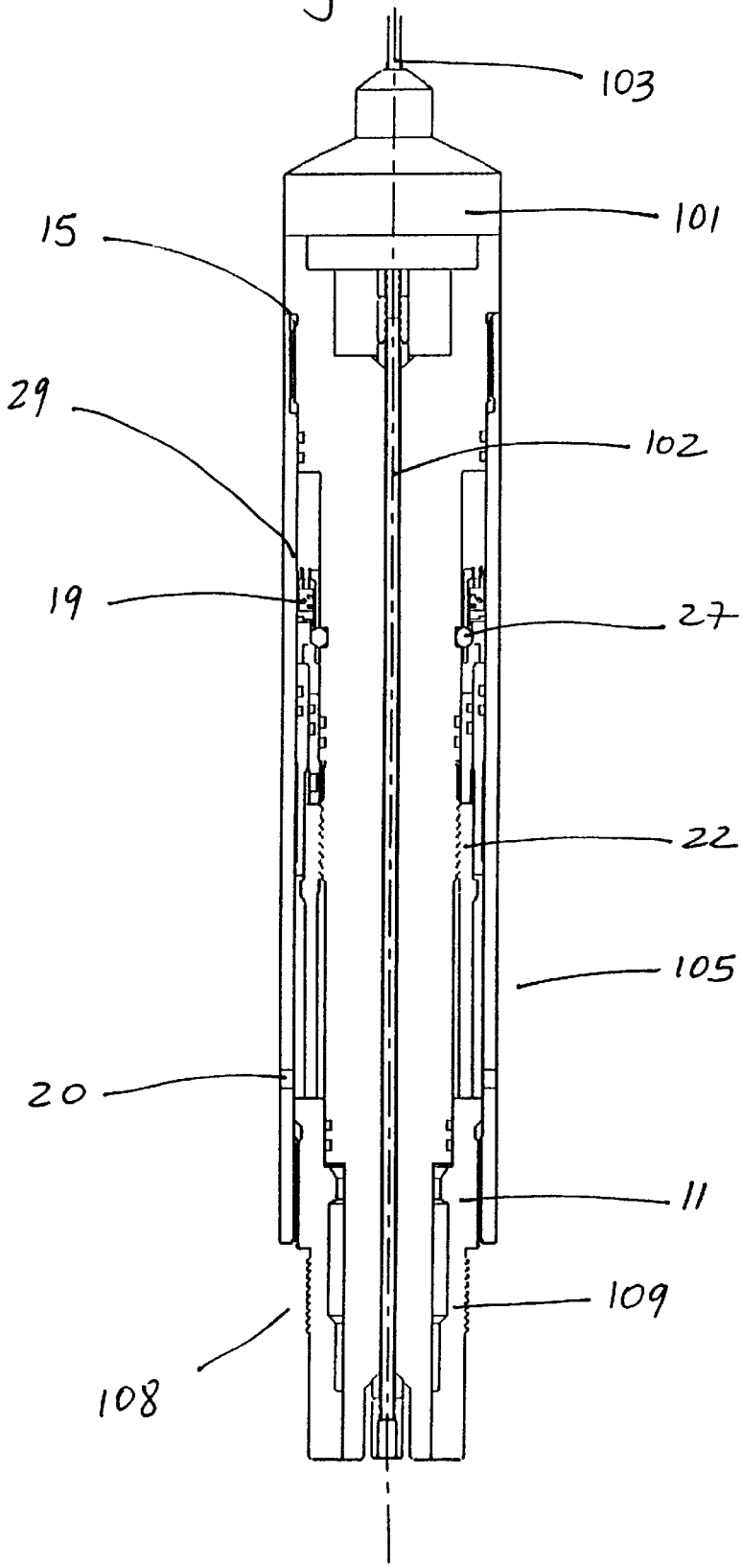
FIG. 4 shows a further embodiment of the apparatus of the invention adapted for use with wire based systems.

FIG. 4 shows a further embodiment of the apparatus 105 adapted for use with wire line based systems. The corresponding parts of the apparatus are essentially the same as in the embodiment described in FIGS. 1 to 3 and the same identifying numerals have been used. In this embodiment, the upper end 7 of the body section is configured for attachment to a wire line connecting tool 101 by means of a central rod 102, and the connecting means 101 is secured to the suspending wire 103. In all other respects, the apparatus operates in the same way as described for the previous embodiment.

What is claimed is:

1. A releasable well bore connector apparatus comprising:

a first support member including first holding means;

a second support member including second holding means;

retaining means normally positioned to hold the first and second holding means in engagement and movable by a fluid pressure in a well provided with said connector to release the first and second holding means;

a chamber maintained at a low pressure corresponding to atmospheric pressure and into which a portion of the retaining means can enter to move so as to effect said release; and a fusible metal plug which holds said portion of the retaining means outside the chamber.

2. The apparatus as claimed in claim 1 wherein the retaining means includes a slidable sleeve around the first support member.

3. The apparatus as claimed in claim 1 wherein the apparatus is adapted to be connected to an end of a coiled tube and includes a through-bore through the first and second support members to allow fluid under pressure to be conveyed through the apparatus.

4. The apparatus as claimed in claim 1 comprising means for connecting the apparatus to a wireline.

5. The apparatus according to claim 1 wherein the fusible metal plug includes tin and/or bismuth.

* * * * *